United States Patent [19]

Flogaus et al.

[11] 4,329,826

[45] May 18, 1982

[54] FASTENER FOR JOINING A STRUCTURAL MEMBER TO MASONRY OR CONCRETE

[76] Inventors: William S. Flogaus, 227 N. Royal St., Alexandria, Va. 22314; Bill A. Blecha, 6425 Rose Hill Dr., Alexandria, Va. 22310

[21] Appl. No.: 176,584

[22] Filed: Aug. 8, 1980

Related U.S. Application Data

[63] Continuation of Ser. No. 971,744, Dec. 21, 1978, abandoned.

[51] Int. Cl.[3] ..... E04B 1/38

[52] U.S. Cl. ..... 52/712; 52/295

[58] Field of Search ..... 52/712–715, 52/295, 300, 370, 698; 248/247, 248, 300

[56] References Cited

U.S. PATENT DOCUMENTS

| | | | |
|---|---|---|---|
| 1,711,415 | 4/1929 | Lane | 52/713 X |
| 2,733,036 | 1/1956 | Meletio | 52/698 |
| 3,422,585 | 1/1969 | Dismukes | 52/295 X |
| 3,561,609 | 2/1971 | Doherty et al. | 248/300 X |
| 3,750,360 | 8/1973 | Kingston | 52/714 |
| 3,893,274 | 7/1975 | Salisbury | 52/698 X |
| 3,998,026 | 12/1976 | Allen | 52/714 |
| 4,033,085 | 7/1977 | Haines | 52/715 |

FOREIGN PATENT DOCUMENTS

| | | | |
|---|---|---|---|
| 7502171 | 8/1976 | Netherlands | 52/712 |
| 1520384 | 8/1978 | United Kingdom | 52/712 |

*Primary Examiner*—J. Karl Bell

*Attorney, Agent, or Firm*—Watson, Cole, Grindle & Watson

[57] ABSTRACT

Disclosed is a fastener adapted for joining a structural member such as a post, rafter, girder, or wire tie downs to concrete or masonry structures. The fastener of the present invention comprises a generally planar elongated member of steel or the like having at least one hole therethrough near one end of the member and having lateral edges near the other end of the member which are inwardly directed scallops. Preferably, the member also includes a hole near the end of the member which has the inwardly directed lateral edges and a hole near the central portion of the member.

9 Claims, 6 Drawing Figures

FASTENER FOR JOINING A STRUCTURAL MEMBER TO MASONRY OR CONCRETE

This is a continuation of application Ser. No. 971,744, filed Dec. 21, 1978, now abandoned.

BACKGROUND OF THE INVENTION

The present invention relates generally to fasteners and is more particularly concerned with fasteners adapted for joining a structural member such as a rafter, post, wire tie downs or the like to concrete, masonry or the like.

In the building trades, it is oftentimes necessary to form joints between concrete or masonry foundations or walls and other structural members such as wooden or metal posts, rafters, sill plates, girders, beams, wire tie downs and the like. Many different specialized means have been devised over the years to accomplish each type of such joints. For example, in joining wooden support posts to concrete foundations, common practice has been to simply embed the post into the concrete while the concrete is wet and then allow the concrete to cure or set about the post. A significant disadvantage of this practice is that the embedded portion of the post tends to rot over a period of time due to entrained moisture.

Another means for joining wooden posts such as carport or deck supports to concrete is to use an embedded J-bolt in the concrete which retains a rather thin, square metal cup which is then nailed to the encapsulated post. This type of fastening means has a definite structural weakness in that the shear or pullout strength of the nails is very low compared to that of the J-bolt, the square cup, or the post. In addition, other disadvantages of a J-bolt-square cup fastening means for joining a post to concrete are that a different sized cup is required for each size of post such as 4×4 or 6×6 and, for many sized posts, a corresponding cup is not presently commercially available. A further disadvantage of the J-bolt-square cup fastening means is that it can be used only for wooden posts and not for metal posts, or sheet metal outbuildings.

In mounting or joining wooden rafters to masonry walls such as in attaching a wooden deck to the existing masonry wall of a house, a header is nailed or bolted to the masonry with the aid of lead anchors set into drilled holes and then the rafters nailed to the header. This approach is oftentimes unsatisfactory as the masonry can be damaged while attaching the header and the strength of the joint may be limited to the pull strength of the nails.

While the above means and methods for joining structural members to concrete or masonry are in primary use today, the patent literature includes many other types of fasteners for the above purposes which, for various reasons, have not found wide acceptability. For example, in U.S. Pat. No. 927,563 to Londelius, a brick anchor comprising a flat elongated steel bar having two holes near one end, one hole near the other end and a round rod projecting through the latter hole is disclosed. U.S. Pat. No. 1,428,327 to Girolami discloses an anchoring or securing device of a generally flat metal body having projecting portions at one end and an enlarged, chisel-like portion at the other end which has an opening therethrough. In U.S. Pat. No. 1,880,709 to Bitney, taught is an anchor for concrete comprising a plate-like body with oppositely disposed flanges on the longitudinal edges each having recessed portions, the body having a hole near each end.

U.S. Pat. No. 1,989,811 to Kulp discloses a concrete insert anchor of sheet metal having a hole near one end and lateral inwardly and downwardly curved edge faces, the anchor having a plurality of corrugations across the major surfaces. The anchor inserts as taught by the U.S. Pat. No. 2,006,300 to Kinninger are of planar sheet metal and include two holes near the center of the inserts and a series of recessed portions along the lateral surfaces of the insert. U.S. Pat. No. 3,750,360 to Kingston discloses an anchor device for securing a wood sill plate to a masonry foundation. In the embodiment shown in FIG. 1 of the Kingston patent, a portion of the U-shaped anchor device comprises a flat elongated member having small recessed portions along the lateral edges and a plurality of holes near both ends of the member.

These known fastening means for joining a structural member to concrete or masonry disclosed in the patent literature as well as those discussed previously suffer from one or more disadvantages such as complicated and expensive manufacture of the fastener, the fastener usefulness is limited to particular applications, insufficient strength of the joint formed by the fasteners, inability to join structural members of varying types, poor anchoring or retention characteristics in concrete or masonry and the necessity for a plurality of components in the fastening means which complicates assembly and increases the cost of the fastening means.

SUMMARY OF THE INVENTION

Accordingly, it is an object of the present invention to provide a fastener for joining structural members to concrete or masonry which is adaptable to a wide variety of applications.

An additional object of the present invention is to provide a fastener which is of simple construction.

A further object of the present invention is to provide a fastener for joining any sized wooden posts or boards to concrete and provide a joint which is both strong and pleasing in appearance.

Yet another object of the present invention is to provide a fastener for joining wooden rafters and the like to concrete or masonry which does not require nails.

Another object is to provide a fastener with which the board or post is easily removed or modified.

Another object is to provide an easily installed fastener for the repair of rotted posts such as in old fences.

A further object of the present invention is to provide a fastener which can be used to easily join steel structural members to concrete or masonry, Another object of the present invention is to provide a fastener for joining structural members to concrete which has means for attachment of the fastener to reinforcing bars within the concrete.

Briefly therefore, the present invention comprehends a fastener adapted for joining a structural member to concrete or masonry comprising a generally planar, elongated member having at least one hole therethrough near one end of the member and having lateral edges near the other end of the member which are inwardly directed in the shape of scallops.

Preferably, the fastener also includes a hole near that end thereof which includes the scallops and a hole near the central portion of the fastener and above the scalloped portions. It is a significant feature of the fastener that the tensile strengths of the fastener across these portions including the holes are approximately equal to one another as well as to the tensile strength of the fastener across the scalloped portions. Additionally, the tensile strengths of the above portions are each approximately equal to the shear strength of concrete along the scalloped portions of the fastener.

Further objects, advantages and features of the present invention will become more fully apparent from a detailed consideration of the arrangement and construction of the invention as set forth in the following specification taken together with the accompanying drawing.

DESCRIPTION OF THE PREFERRED EMBODIMENTS

Figure 1:
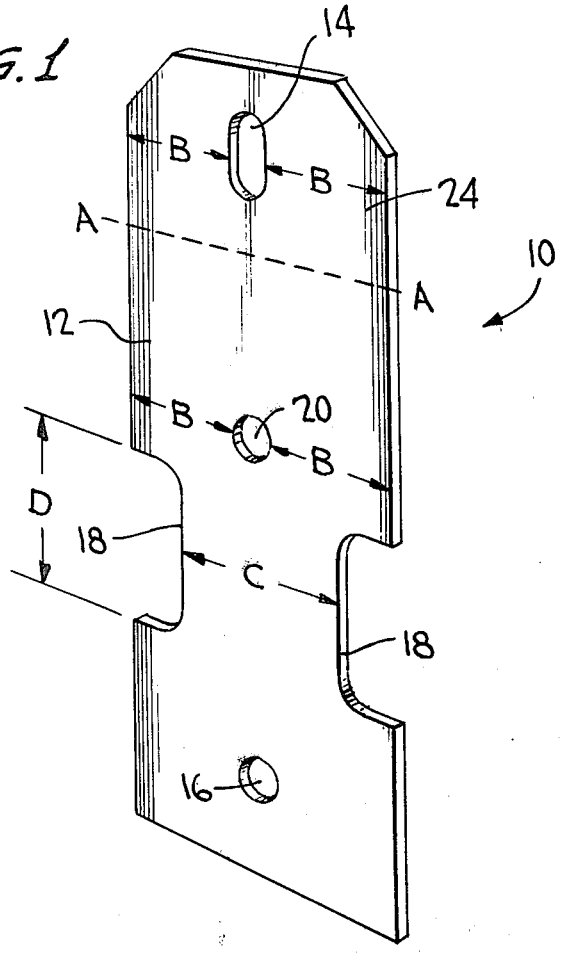
FIG. 1 is a perspective view of one embodiment of a fastener in accordance with the present invention.

Referring now to FIG. 1, shown is fastener 10 in accordance with the present invention. Fastener 10 comprises a generally planar, elongated member 12 which is preferably of metal such as hot rolled steel. At one end of member 12 is elongated hole 14 and at the other end is circular hole 16. A portion of each of the lateral edges of member 12 above hole 16 are inwardly directed in the shape of scallops 18. Member 12 is also provided with a hole 20 near the central portion of the fastener.

Fastener 10 is adapted to be partially embedded in concrete, mortar or like structure so as to enable a structural member to be fastened to the structure. Preferably, lower portion 22 of member 12, that is, the portion below dashed line A—A, is embedded in the structure and upper portion 24 of the member projects outwardly for attachment to a structural member (not shown).

Scallops 18 on the lateral edges of member 12 help to provide anchoring support for fastener 10 while embedded in concrete or the like by helping to resist longitudinal forces on the fastener. While scallops 18 as shown have a generally oval shape, it should be realized that the scallops could have other configurations as well. Suitable configurations for scallops 18 may include arcuate, parabolic, elliptical, irregular, straight line segments, rectangular and the like. Preferably scallops 18 are "oval" for ease of fabrication since the scallops can be formed with a conventional oval punch of a standard size.

Hole 16 also helps to provide additional anchoring support for fastener 10 by being filled with concrete, or alternatively, by being positioned about a reinforcing bar within the concrete. Hole 14 provides a convenient means for attachment of fastener 10 to a structural member by bolts, clamps or the like.

The tensile strengths of the portions B and C of the fastener are designed to be approximately equal, and in turn are equal to the shear strength of concrete along the distance D of scalloped portions 18.

Figure 2:
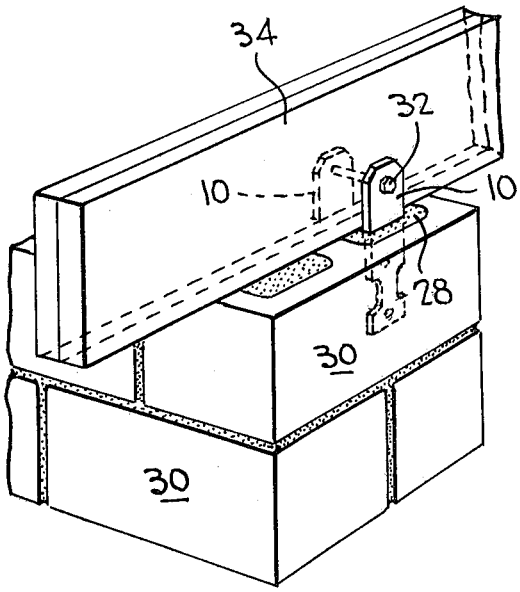
FIG. 2 illustrates one manner in which the fastener embodiment of FIG. 1 may be utilized.
Figure 3:
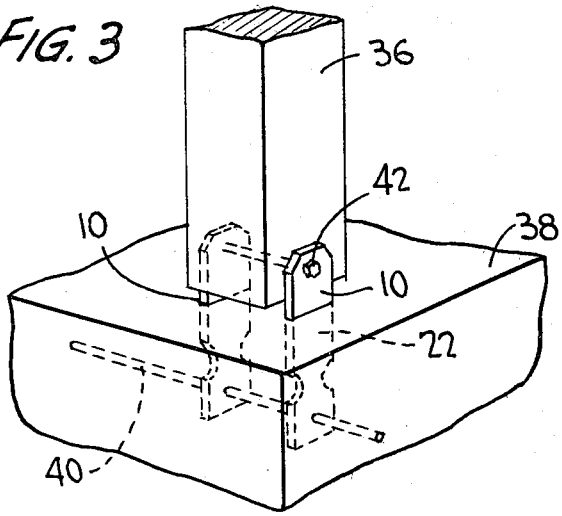
FIG. 3 illustrates another manner in which the fastener embodiment of FIG. 1 may be utilized.

Possible uses of fastener 10 are more clearly shown in FIGS. 2 and 3. In FIG. 2, lower portion 22 of two fasteners 10 have been embedded in concrete 28 poured into openings of blocks 30 forming a pier. Bolt 32 passing through both holes 14 of fasteners 10 securely holds girder 34 to the pier.

In FIG. 3, fasteners 10 have been utilized to join a wooden deck post 36 or the like to concrete support structure 38. The lower portions 22 of two fasteners 10 have been embedded in structure 38 with reinforcing bar 40 within the concrete passing through holes 16 of each fastener. A bolt 42 passes through hole 14 in the upper portion 24 of each fastener 10 and also through bored hole (not shown) in post 36 so as to securely affix the post to concrete structure 38. If desired, an elevated concrete pad (not shown) may be formed in the space between the bottom of post 36 and the surface of concrete structure 38 so as to provide a more finished appearance.

Other uses (not shown) for fasteners 10 include partially embedding the fasteners in the mortar of a brick or block wall such that the fasteners extend horizontally so as to allow attachment of a rafter or the like to the wall. In addition, fastener 10 may be partially embedded vertically in a concrete foundation and the upper portion 24 of the fastener including hole 14 bent over and attached to a wooden sill plate by a bolt, nail or clamp.

Figure 4:
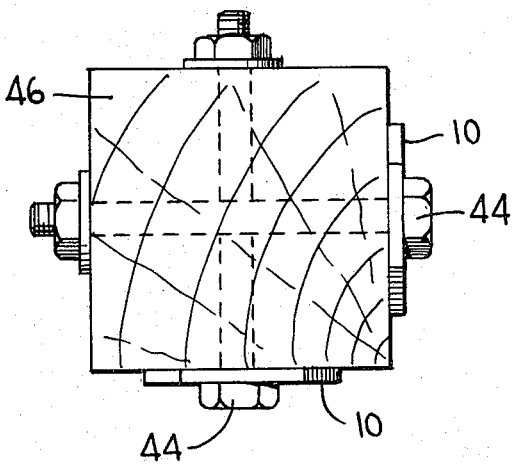
FIG. 4 is a top view of two fasteners in accordance with the present invention which have been crossbolted onto a post.

As was mentioned previously, hole 14 in upper portion 24 of fastener 10 provides a convenient means for attachment of the fastener to a structural member. Preferably hole 14 is of an elongated configuration as such a configuration allows, among other things, the use of a lateral clamp bolt (not shown) with a pair of fasteners or, as is shown in FIG. 4, allows two fasteners 10 at the same vertical elevation to be crossbolted by bolts 44 to wooden post 46.

Figure 5:
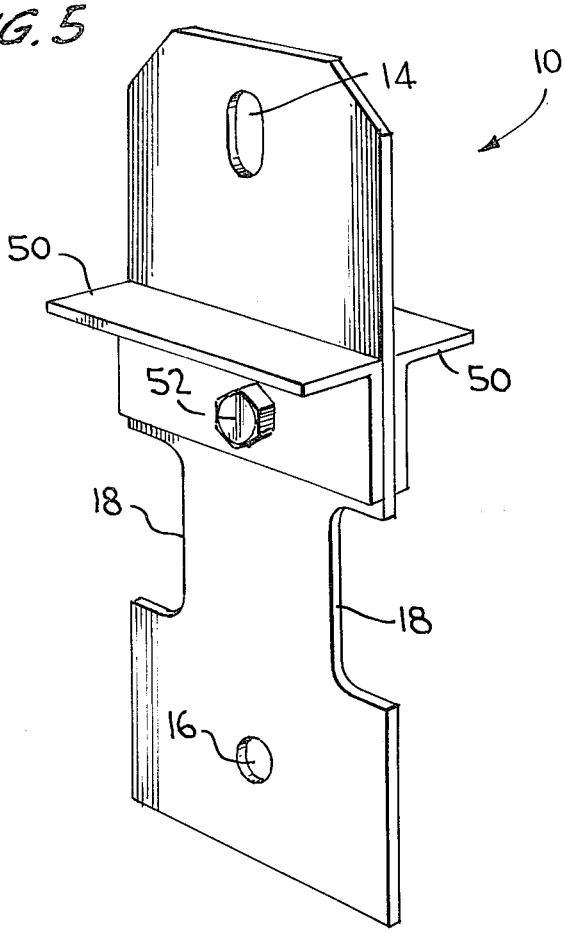
FIG. 5 is a perspective view of the embodiment of FIG. 1 having two brackets attached thereto.

FIG. 5 illustrates a modified form of fastener 10 of FIG. 1 where two L-shaped brackets 50 have been attached to the fastener by means of bolt 52 and a nut (not shown), the bolt passing through hole 20 of the fastener.

Figure 6:
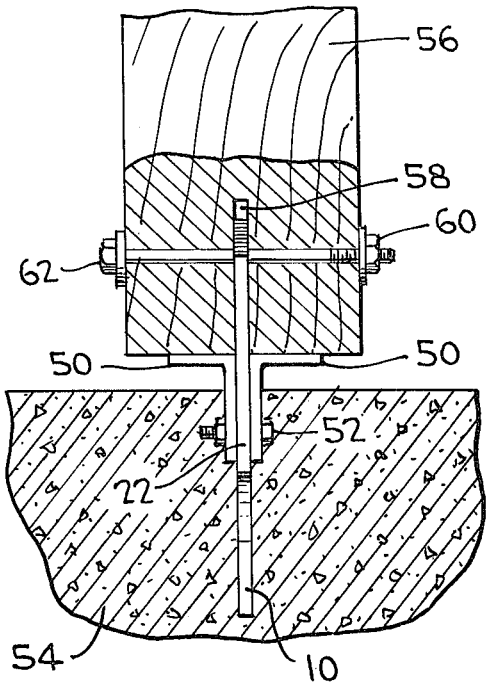
FIG. 6 is a partial cross-sectional view illustrating one means of utilizing the fastener illustrated in FIG. 5.

A preferred use for fastener 10 having attached brackets 50 is shown in FIG. 6 where lower portion 22 of the fastener has been embedded in concrete 54 and upper portion 24 fit into a slot 58 in wooden post 56. The outwardly extending portions of brackets 50 help to support post 56 while nut 60 and bolt 62 passing through hole 14 of fastener 10 and through a bored hole in the post secure the post to the fastener and hence to concrete 54. An advantage of the use of fastener 10 and brackets 50 as shown in FIG. 6 is that only one fastener is necessary to support the post and the joint is essentially hidden from view and thereby presents an uncluttered appearance.

While the use of two brackets 50 as shown is presently higher in strength, clearly fastener 10 and bracket would function in the same manner if only one bracket was included.

While the fastener of the present invention may be made in whatever size necessary to fulfill the strength requirement of the particular joint to be made, a presently preferred size of the fastener for universal applications is about three inches wide, about ten inches long and about $\frac{1}{8}$ inch thick. When fabricated of hot rolled steel, such a fastener has a yield strength of about 12,000 lbs. in the longitudinal direction.

As is evident from the above description, a fastener in accordance with the present invention can be utilized in a variety of different situations where a joint between concrete, masonry or the like and a structural member or fence post is required. Thus, a large inventory of different types of fasteners for different applications may not be required for one in the construction or building trade.

In addition, due to the simple design of the fasteners, the fasteners can be manufactured easily and economically from sheet stock such as hot rolled steel sheet using conventional equipment.

While the present invention has been described with reference to a particular embodiment thereof, it will be understood that numerous modifications may be made by those skilled in the art without actually departing from the spirit and scope of the invention as defined in the appended claims.

What is claimed is:

1. A fastener adapted for joining a structural member to masonry or concrete, comprising a generally planar metallic member elongated along a longitudinal axis thereof including a hole at one end thereof and adapted for fastening to a structural member, at least a portion of the lateral edges near the end of the elongated member opposite said hole having inwardly directed scallops adapted for securing the fastener in masonry or concrete, a second hole near the central portion of said member for attaching components to the fastener, wherein the portions of the fastener between said hole and an associated edge of the fastener as well as the portion of the fastener between the scallops have substantially equal tensile strength which is also substantially equal to the shear strength of concrete represented by the length of each of the scallops along the longitudinal direction of the fastener; and at least one L-shaped bracket attached to the member by means projecting through said second hole.

2. A fastener according to claim 1 wherein the hole at the end of the member is elongated.

3. A fastener according to claim 1 further including a hole near the end of the member having the inwardly directed lateral edges for securing the fastener in masonry or concrete.

4. A fastener according to claim 1 wherein the shape of the scallops is semi-circular.

5. A fastener according to claim 1 wherein the shape of scallops is oval.

6. A fastener according to claim 1 wherein the generally planar, elongated member is of thin steel plate and said hole is of an elongated configuration, the member further including a circular hole near the end of the member having the inwardly directed lateral edges adapted for securing the fastener in masonry or concrete and another circular hole near the central portion of the member adapted for attaching components to said fastener, the inwardly directed scallops on the lateral edges of the member each having an oval shape.

7. A fastener adapted for joining a structural member to masonry or concrete, comprising a generally planar metallic member elongated along a longitudinal axis thereof including a hole at one end thereof and adapted for fastening to a structural member, at least a portion of the lateral edges near the end of the elongated member opposite said hole having inwardly directed scallops adapted for securing the fastener in masonry or concrete, and wherein the portions of the fastener between said hole and an associated edge of the fastener as well as the portion of the fastener between the scallops have substantially equal tensile strength which is also substantially equal to the shear strength of concrete represented by the length of each of the scallops along the longitudinal direction of the fastener; said fastener being embedded in concrete or masonry with said hole exposed, and further comprising a structural member attached to the exposed portion of the fastener by fastening means extending through said hole and engaging said structural member; and at least one other fastener according to claim 1 embedded in the masonry or concrete in opposed relationship to the other embedded fastener and wherein the structural member is secured to both of the fasteners by a fastening means extending through said hole in each of said fasteners.

8. A fastener adapted for joining a structural member to masonry or concrete, comprising a generally planar metallic member elongated along a longitudinal axis thereof including a hole at one end thereof and adapted for fastening to a structural member, at least a portion of the lateral edges near the end of the elongated member opposite said hole having inwardly directed scallops adapted for securing the fastener in masonry or concrete, and wherein the portions of the fastener between said hole and an associated edge of the fastener as well as the portion of the fastener between the scallops have substantially equal tensile strength which is also substantially equal to the shear strength of concrete represented by the length of each of the scallops along the longitudinal direction of the fastener; and said fastener being embedded in concrete or masonry and wherein said fastener further includes an exposed hole substantially intermediate the respective ends of the fastener and at least one L-shaped bracket attached to the fastener by means projecting through the intermediate hole near the central portion of the member, and a structural member attached to the said L-shaped bracket.

9. The combination as set forth in claim 8 wherein said fastener further comprises another hole at the end of the fastener including the inwardly directed scallops and a tie-rod embedded in the masonry and concrete and extending through said other hole for aiding in securing the fastener to the masonry or concrete.

* * * * *